United States Patent [19]

Moore, Jr.

[11] 4,433,517

[45] Feb. 28, 1984

[54] WINDOW ASSEMBLY

[76] Inventor: Franklin Moore, Jr., 902 McBurney Dr., Lebanon, Ohio 45036

[21] Appl. No.: 338,423

[22] Filed: Jan. 11, 1982

[51] Int. Cl.[3] ..... E06B 3/20

[52] U.S. Cl. ..... 52/204; 52/309.15; 52/404

[58] Field of Search ..... 52/204, 202, 203, 404, 52/406, 309.1, 309.15, 716

[56] References Cited

U.S. PATENT DOCUMENTS

| | | | |
|---|---|---|---|
| 2,939,811 | 6/1960 | Dillon | 52/309.15 X |
| 3,591,985 | 7/1971 | Coppins | 52/204 X |
| 3,996,710 | 12/1976 | Nuss | 52/202 |
| 4,248,933 | 2/1981 | Katoh | 52/716 X |
| 4,320,609 | 3/1982 | Abell | 52/202 |

FOREIGN PATENT DOCUMENTS

| | | | |
|---|---|---|---|
| 2461800 | 3/1981 | France | 52/204 |
| 2034382 | 6/1980 | United Kingdom | 52/204 |

OTHER PUBLICATIONS

Butler Manufacturing Company, Kansas City, Missouri, Drawing L03262—02.

Alamo Building Systems, San Antonio, Texas, entitled "WINDOWS".

Component Building Systems, Inc., Birmingham, Alabama, Title "The best Architectural Fixed Window . . . ".

*Primary Examiner*—J. Karl Bell

*Attorney, Agent, or Firm*—Jacox & Meckstroth

[57] ABSTRACT

An inner shell of rigid molded plastics material opposes an outer shell of rigid molded plastics material, and the shells have corresponding inwardly projecting adjacent flanges defining a rectangular window opening. A transparent window panel is clamped and sealed against the flanges by a rectangular trim member having a lip portion surrounding the window panel and retained by U-shaped spring clips attached to the outer shell. The inner and outer shells further include opposing contoured rectangular trim portions surrounding the window panel and defining a cavity filled with thermal insulation. The shells also have outwardly projecting flat border portions which surround the contoured trim portions and are spaced by rigid wood frame panels.

11 Claims, 4 Drawing Figures

WINDOW ASSEMBLY

BACKGROUND OF THE INVENTION

In the construction of window assemblies adapted for installation within the side walls of a metal building or other types of buildings, it is common to use extruded aluminum frame sections which are assembled to form a rectangular frame for surrounding one or more rectangular window glazings or glass panels to form a window unit. A weather-tight seal is provided between the window panels and the surrounding rectangular aluminum frame, and usually the assembled unit is installed between horizontally spaced vertical metal channels or studs which interrupt the horizontal wall girts within one or more of the side walls of the metal building. Sometimes, the extruded aluminum sections or members which form the rectangular frame are provided with extruded plastics connecting elements which form thermal barriers to limit heat transfer through the frame.

It has been found that the above described form of window unit or assembly requires substantial time for installation within the wall of the building. The aluminum window frames also have a relatively low "R" insulation value and usually require the preconstruction of horizontally spaced vertical metal studs or channels within the wall where a window unit is to be located. The aluminum frame window units are also relatively expensive in construction, and it is not economically practical to offer the aluminum frames in a variety of different anodized colors.

SUMMARY OF THE INVENTION

The present invention is directed to an improved window unit or assembly which provides for conveniently and quickly installing a transparent window panel within the side wall of a building and which is ideally suited for installation within a side wall of a conventional metal building. The window assembly of the invention provides a structural flat rectangular frame extending around the window panel and which eliminates the need for prelocating horizontally spaced vertical metal studs or channels within the wall, and the assembly further provides for a substantial decrease in the thermal conductivity of the window assembly. A window assembly constructed in accordance with the invention also provides durable and weather resistant inner and outer surfaces, and the inner surface is configured to accommodate drywall or wood panels for forming an interior wall within the building. In addition, the window assembly of the invention provides for conveniently installing and removing a transparent glass panel or glazing while also providing for a positive weather-tight seal.

In accordance with one embodiment of the invention, the above features and advantages are provided by a window assembly which incorporates an inner shell and an outer shell of molded reinforced plastics material, and the inner and outer shells are assembled with opposing flat rectangular border portions spaced by a rectangular wood frame. The inner and outer shells have rectangular contoured trim portions which define a cavity for receiving a thermal insulation material, and the inner and outer skins have inwardly projecting rectangular flanges which receive one or more transparent glass panels or glazing. The glass panel or panels are clamped to the rectangular flanges by a rectangular trim member having a leg portion received by spring clips secured to the outer shell at peripherally spaced intervals around the window.

Other features and advantages of the invention will be apparent from the following description, the accompanying drawing and the appended claims.

DESCRIPTION OF THE PREFERRED EMBODIMENTS

Figure 1:
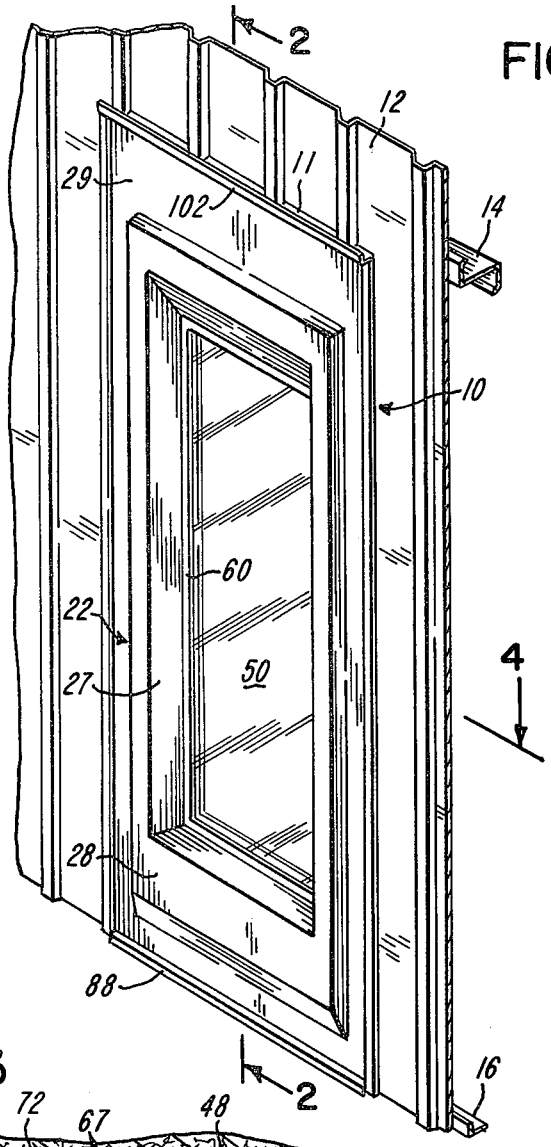
FIG. 1 is a perspective view of a window assembly constructed in accordance with the invention and illustrating the assembly installed within a wall of a metal building.

FIG. 1 illustrates a window unit or assembly 10 constructed in accordance with the invention and which is installed within a rectangular opening 11 (FIG. 2) formed within an outer roll-formed sheet metal skin or wall panel 12 of a metal building. In a conventional metal building, the sheet metal wall panels 12 are attached to Z-shaped wall girts 14 which form part of the frame for the metal building. The wall panels are also attached to base angle members 16 which are secured to a floor such as the concrete floor 17 shown in FIG. 2.

The window assembly 10 includes an outer skin or shell 22 and an inner skin or shell 24 each of which is molded of a fiberglass reinforced plastics material. The resin coating which forms the outer surface of each shell 22 and 24 is selected according to the desired color which is coordinated with the color of the outer sheet metal panel 12 and the interior color of the room within the building.

Figure 2:
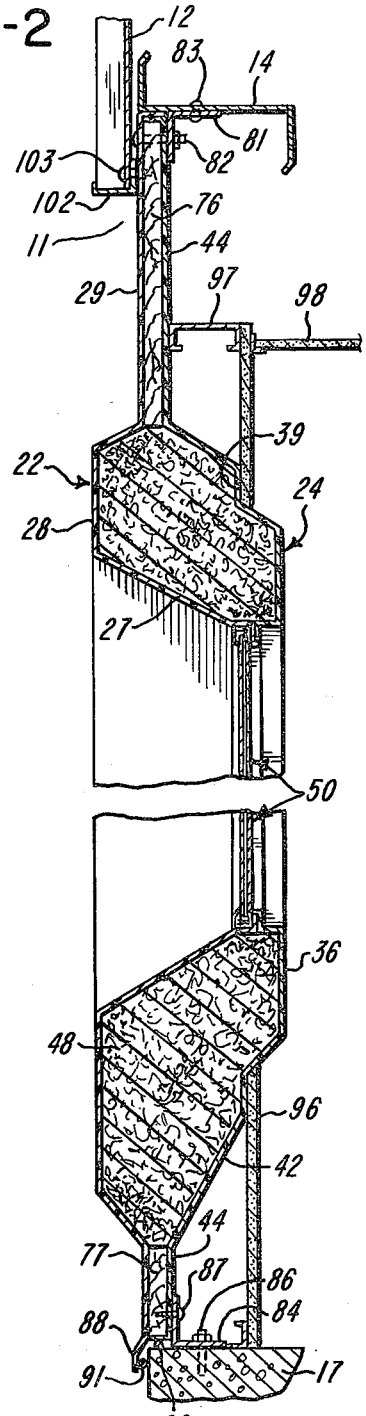
FIG. 2 is a vertical section of the window assembly and a portion of the surrounding metal building structure as taken generally on the line 2—2 of FIG. 1, and with a center portion broken away.

As shown in FIG. 2, the outer skin or shell 22 has a substantially uniform thickness and includes a rectangular truncated or tapering portion 27 which extends from a rectangular contoured trim portion 28. A flat rectangular frame-like border portion 29 surrounds the trim portion 28. The portions 27, 28 and 29 are integrally molded, and the truncated portion 27 terminates with an inwardly projecting frame-like window stop or flange 32 (FIG. 3).

Figure 4:
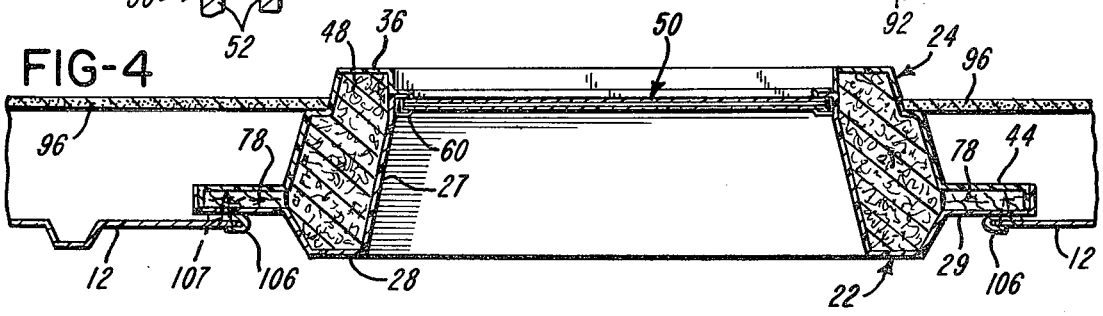
FIG. 4 is a horizontal section of the window assembly and adjacent wall portion, as taken generally on the line 4—4 of FIG. 1.

The inner skin or shell 24 of the window assembly 10 also has a generally uniform wall thickness and includes a rectangular contoured trim portion 36 which terminates with an inwardly projecting flange 37 positioned adjacent the flange 32 of the outer skin 22. The contoured rectangular trim portion 36 projects inwardly into the building from a flat frame-like seat portion 39 which, in turn, connects with a surrounding tapering portion 42. The flange 37 and the wall portions 36, 39 and 42 of the inner skin 24 are integrally molded along with a rectangular flat border portion 44 which surrounds the tapering portion 42. As shown in FIGS. 2 and 4, the wall portions 27 and 28 of the outer shell 22 oppose the wall portion 36, 39 and 42 of the inner shell 24 and cooperate to define a frame-like cavity which surrounds the tapering wall portion 27 and is filled with a thermal insulation material such as fiberglass insulation 48.

Figure 3:
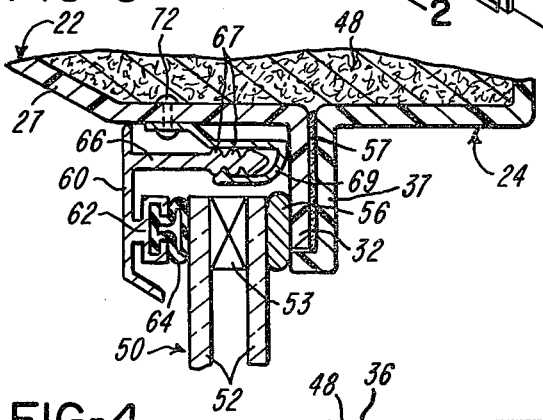
FIG. 3 is an enlarged fragmentary section showing the assembly of the transparent window or glass panels or glazing.

As best shown in FIG. 3, a transparent rectangular window panel 50 is shown as being formed by two glazings or glass panes 52 which are bonded together by a rectangular frame-like spacer member 53. However, the window panel 50 may be formed by one or a plurality of glazings or panes 52. A deformable and resilient glazing tape or seal 56 extends between the window panel 50 and the adjacent flanges 32 and 37 of the inner and outer shells and forms a fluid-tight seal therebetween. A layer of adhesive 57 forms a bond between the flanges 32 and 37 and secures together the inner portions of the outer shell 22 and inner shell 24.

A rectangular frame-like mullion or trim member 60 is shown as being formed from sections of an aluminum extrusion and extends around the window panel 50. However the trim member 60 may be of plastics or other materials or the like. The trim member 60 is shown as including an inwardly projecting channel portion 62 which defines a groove for receiving a resilient and flexible vinyl seal 64 positioned for engaging the outer peripheral surface of the window panel 50. However, the channel 62 may be of vinyl or other plastics materials or the like. The trim mullion or member 60 also includes an inwardly projecting lip or leg portion 66 which extends around the window panel 50 and has a plurality of longitudinally extending grooves defining parallel spaced ribs 67. The trim member 60 is removably retained by a series of peripherally spaced spring clips 69 which are secured to the trim portion 28 by rivets 72 spaced around the window panel 50, and the clips 60 frictionally engage the ribs 67. Thus, the removable frame-like trim member 60 cooperates with the frame-like flanges 32 and 37 to clamp or confine the window panel 50, and the seals 56 and 64 form a weather-tight seal between the panel 50 and the shells 22 and 24 in addition to dampening vibrations of the window panel 50.

As shown in FIGS. 2 and 4, the opposing flat border portions 29 and 44 of the outer shell 22 and inner shell 24 are bonded by adhesive to flat wood sheets or spacer panels including a header panel 76, a bottom or base panel 77 and opposite side panels 78 (FIG. 4). The frame-like arrangement of the flat wood panels 76–78 cooperate with the attached flat border portions 29 and 44 of the fiberglass shells 22 and 24 to form a rigid structural frame surrounding the inner portions of the mating inner and outer shells 22 and 24.

The installation of a window assembly 10 is relatively simple and may be accomplished in a short period of time. After the rectangular opening 11 is formed within the outer sheet metal wall panel 12 of the metal building, the window unit 10 is positioned in place as shown in FIG. 2, and the upper header portion of the window assembly 10 is attached to an overhead horizontal wall girt 14 by a set of angle brackets 81 and suitable fasteners 82 and 83. Similarly, the bottom or base portion of the window assembly 10 is attached to the floor 17 by a set of angle brackets 84 and suitable fasteners 86 and 87.

As shown in FIG. 2, the bottom edge portion 88 of the outer shell 22 projects downwardly over the floor 17 to form a drip lip, and a bead or rod 91 of caulking or sealant material forms a seal between the bottom edge portion 88 and the outer edge surface of the floor 17. Preferably, another bead or rod 92 of caulking or sealant material is located between the lower edge surface of the base spacer panel 77 and the surface of the floor 17. As further shown in FIG. 2, the flat rectangular wall portion 39 of the inner shell 24 forms a seat or surface for receiving and supporting interior panels 96, which may be drywall or of other materials, which are usually mounted on sheet metal studs and cross members 97 and extend from the floor 17 to a ceiling 98 for an interior room within the building.

Referring to FIG. 2, a sheet metal drip gutter or trim member 102 extends across the top of the opening 11 within the sheet metal wall panel 12 and is secured to the header portion of the window assembly 10 by a series of screws 103 which extend through the sheet metal wall panel 12 and into the wood spacer panel 76. Similarly, a set of U-shaped sheet metal trim members or molding strips 106 (FIG. 4) are secured by threaded fasteners or screws 107 to the side wood border panels 78 of the window assembly 10. The strips 106 receive the vertical edge portions of the sheet metal panels 12 defining the rectangular opening 11.

From the drawing of the above description, it is apparent that a window assembly constructed in accordance with the present invention provides desirable features and advantages. For example, the window assembly provides for an economical construction and a high thermal insulation or "R" factor. The assembly is also each to install within an opening formed in the wall of a building and provides a highly durable and weather resistant outer surface which is easy to clean and provides the appearance of a concrete modular window unit.

The sandwiched construction of the window assembly and the contour of the inner and outer shells also provide the window assembly with substantial rigidity for withstanding high wind loads. The contour of the inner shell 24 also provides a seat for the drywall panels 96, and the space defined between drywall panels and the base portion of the window assembly is desirable for extending electrical lines, piping or air ducts below the window assembly. The attachment of the window panel 50 with the trim member 60 and spring clips 69 also enables the window panel to be easily and quickly assembled and removed in the event it becomes necessary to replace the window panel.

While the form of window assembly herein described constitutes a preferred embodiment of the invention, it is to be understood that the invention is not limited to this precise form of assembly, and that changes may be made therein without departing from the scope and spirit of the invention as defined in the appended claims.

The invention having thus been described, the following is claimed:

1. A window assembly adapted for mounting within an opening in a wall panel of a building, comprising an inner shell of molded rigid plastics material, an outer shell of molded rigid plastics material and mating with said inner shell, said inner and outer shells disposed in opposing relation and having means defining a window opening, means for securing a transparent window panel within said window opening, said inner and outer shells including corresponding generally rectangular frame-like trim portions surrounding said window panel, said inner and outer shells further including corresponding substantially flat and parallel spaced opposing border portions extending around said trim portions, substantially rigid spacer means disposed between said opposing border portions of said inner and outer shells, said trim portions being contoured and projecting outwardly from the planes of the corresponding said border portions in opposite directions to define a cavity therebetween, insulation means disposed within said cavity between said opposing trim portions of said inner and outer shells, and means connecting said inner and outer shells with said spacer means confined between said border portions.

2. A window assembly as defined in claim 1 wherein said means for securing said window panel comprise an inwardly projecting frame-like integral flange portion on at least one of said shells and defining said window opening, means forming a seal between said flange portion and said window panel, a frame-like trim member having an inwardly projecting leg portion surrounding said window panel, and a plurality of clip members connected to said outer shell and engaging said leg portion of said trim member for clamping said window panel against said flange portion of said one shell.

3. A window assembly as defined in claim 2 wherein said trim member includes a portion supporting a flexile seal engaging said window panel, said leg portion of said trim member including a plurality of parallel spaced ribs, and said clip membes each include a U-shaped spring portion engaging said ribs on said leg portion and providing for removing said trim member to replace said window panel.

4. A window assembly as defined in claim 1 wherein both of said inner and outer shells include inwardly projecting integral flange portions defining said opening, said flange being disposed in adjacent relation, and means connecting said flange portions.

5. A window assembly as defined in claim 1 wherein said spacer means comprise a generally flat rigid spacer panel surrounding said window opening and attached to said opposing border portions of said inner and outer shells.

6. A window assembly as defined in claim 5 wherein said generally flat spacer panel comprises flat panels of wood material having uniform thickness.

7. A window assembly as defined in claim 1 wherein said outer shell includes a truncated pyramid wall portion extending outwardly from said window panel.

8. A window assembly as defined in claim 1 wherein said inner shell includes a sustantially planar surface surrounding said trim portion to form a seat for an interior vertical wall panel for the building.

9. A window assembly adapted for mounting within an opening in a wall panel of a building, comprising an inner shell of molded rigid plastics material, an outer shell of molded rigid plastics material and mating with said inner shell, said inner and outer shells disposed in opposing relation and having at least one inwardly projecting flange portion defining a window opening, a transparent window panel, means including a frame-like trim member for securing said window panel within said window opening adjacent said flange portion, said inner and outer shells having corresponding frame-like contoured trim portions surrounding said window opening, said inner and outer shells having corresponding opposing generally flat border portions surrounding said trim portions, substantially rigid spacer panels disposed between said opposing border portions of said inner and outer shells, and means connecting said inner and outer shells with said spacer panels confined between said border portions.

10. A window assembly as defined in claim 9 wherein said frame-like trim member has an inwardly projecting leg portion surrounding said window panel, and a plurality of clip members connected to said outer shell and engaging said leg portion of said trim member for clamping said window panel against said one flange portion.

11. A window assembly as defined in claim 9 wherein, said trim portions are rectangular and project outwardly from the corresponding said border portions in opposite directions to define a cavity therebetween, and insulation means disposed within said cavity between said opposing trim portions of said inner and outer shells.

* * * * *

UNITED STATES PATENT AND TRADEMARK OFFICE

CERTIFICATE OF CORRECTION

PATENT NO. : 4,433,517

DATED : February 28, 1984

INVENTOR(S) : Franklin Moore, Jr.

It is certified that error appears in the above-identified patent and that said Letters Patent are hereby corrected as shown below:

Column 3, line 34, change "60" to ---69---.

Column 5, line 30, after "flange", insert ---portions---.

Signed and Sealed this

Tenth Day of July 1984

[SEAL]

*Attest:*

GERALD J. MOSSINGHOFF

*Attesting Officer*

*Commissioner of Patents and Trademarks*